US005573355A

United States Patent [19]

Thomas

[11] Patent Number: 5,573,355

[45] Date of Patent: Nov. 12, 1996

[54] OFFSHORE OIL DRILLING AND PRODUCING PLATFORM PROVIDED WITH IMPROVED MEANS FOR ANCHORING IN THE SEA BED

[75] Inventor: Pierre-Armand Thomas, Puteaux, France

[73] Assignee: TECHNIP Geoproduction, Paris, France

[21] Appl. No.: 515,621

[22] Filed: Aug. 16, 1995

[30] Foreign Application Priority Data

Aug. 30, 1994 [FR] France ..... 94-10432

[51] Int. Cl.[6] ..... E02B 17/02

[52] U.S. Cl. ..... 405/227; 405/228

[58] Field of Search ..... 405/227, 228, 405/224, 195.1, 226; 175/5, 9; 254/1

[56] References Cited

U.S. PATENT DOCUMENTS

| | | | |
|---|---|---|---|
| 3,987,636 | 10/1976 | Hruska et al. | 405/227 X |
| 4,322,182 | 3/1982 | Ostgaard | 405/227 |
| 4,696,604 | 9/1987 | Finn et al. | 405/227 |
| 4,917,541 | 4/1990 | Carruba | 405/227 |
| 5,012,875 | 5/1991 | Casbarian et al. | 405/227 X |
| 5,094,568 | 3/1992 | Carruba | 405/227 |
| 5,257,879 | 11/1993 | Veronelli | 405/227 X |

FOREIGN PATENT DOCUMENTS

| | | |
|---|---|---|
| 0056635 | 7/1982 | European Pat. Off. . |
| 2199038 | 5/1974 | France . |

OTHER PUBLICATIONS

Patent Abstracts Of Japan, vol. 010, No. 368 (M–543), 9 Dec. 1986 & JP–A–61 162620 (Mitsui Kaiyo Kaihatsu KK) 23 Jul. 1986, the summary.

Patent Abstracts Of Japan, vol. 012, No. 182 (M–702), 27 May 1988 & JP–A–62 291314 (Nippon Kokan KK) 18 Dec. 1987, the summary.

*Primary Examiner*—Stephen J. Novosad

*Attorney, Agent, or Firm*—Wenderoth, Lind & Ponack

[57] ABSTRACT

Offshore oil drilling or producing platform comprising a hull (1) carried by legs (2) provided with feet (3) adapted to rest on the sea bed, characterized in that the walls of each of the legs (2) define a space opening onto the respective foot (3) in which are retracted anchoring piles (5) for the leg carried by the foot, each leg (2) being also provided in its upper part with support means (7) in vertical alignment with the piles within the space defined by the walls of the leg (2) for supporting a device for driving the piles into the sea bed.

14 Claims, 4 Drawing Sheets

OFFSHORE OIL DRILLING AND PRODUCING PLATFORM PROVIDED WITH IMPROVED MEANS FOR ANCHORING IN THE SEA BED

The present invention relates to platforms for oil drilling and more particularly but not exclusively relates to offshore oil drilling and/or producing jack-up platforms.

Offshore drilling platforms comprise legs which are placed directly on the sea bed down to depths of about 100 m. However, for a long stay on the site corresponding to the normal duration of a production campaign, the legs of a platform must be firmly anchored in the sea bed and in order to consolidate the foundations, each of the legs of the platform must be fixed by means of piles driven deeply into the ground which, bearing in mind the dimension of such piles, is a long and costly operation, since it requires the use of heavy equipment of which the operating cost is extremely high.

An object of the invention is to overcome the drawbacks of known processes by providing an offshore oil drilling or production platform of which the cost of installation on a site at sea is considerably reduced and which avoids risks pertaining to erosion and settling.

The invention therefore provides an offshore oil drilling or producing platform comprising a hull carried by legs provided with feet adapted to rest on the sea bed, characterized in that the walls of each of the legs define a space which opens onto the corresponding foot and in which are retracted piles for anchoring the leg carried by the foot, each leg also being provided in its upper part with support means in vertical alignment with said piles within the space defined by the walls of the leg, for supporting a device for driving said piles into the ground below the sea bed.

According to a feature of the invention, the anchoring piles are carried by a support which is part of the foot and is separable from the latter.

According to another feature of the invention, each leg is provided with means for guiding the piles in the course of the driving thereof.

According to a further feature of the invention, each foot also carries peripheral anchoring piles adapted to resist tilting forces to which the platform is subjected, in particular under the effect of the swell of the sea.

A better understanding of the invention will be had from the following description, with reference to the accompanying drawings which are given solely by way of example and in which.

Figure 1:
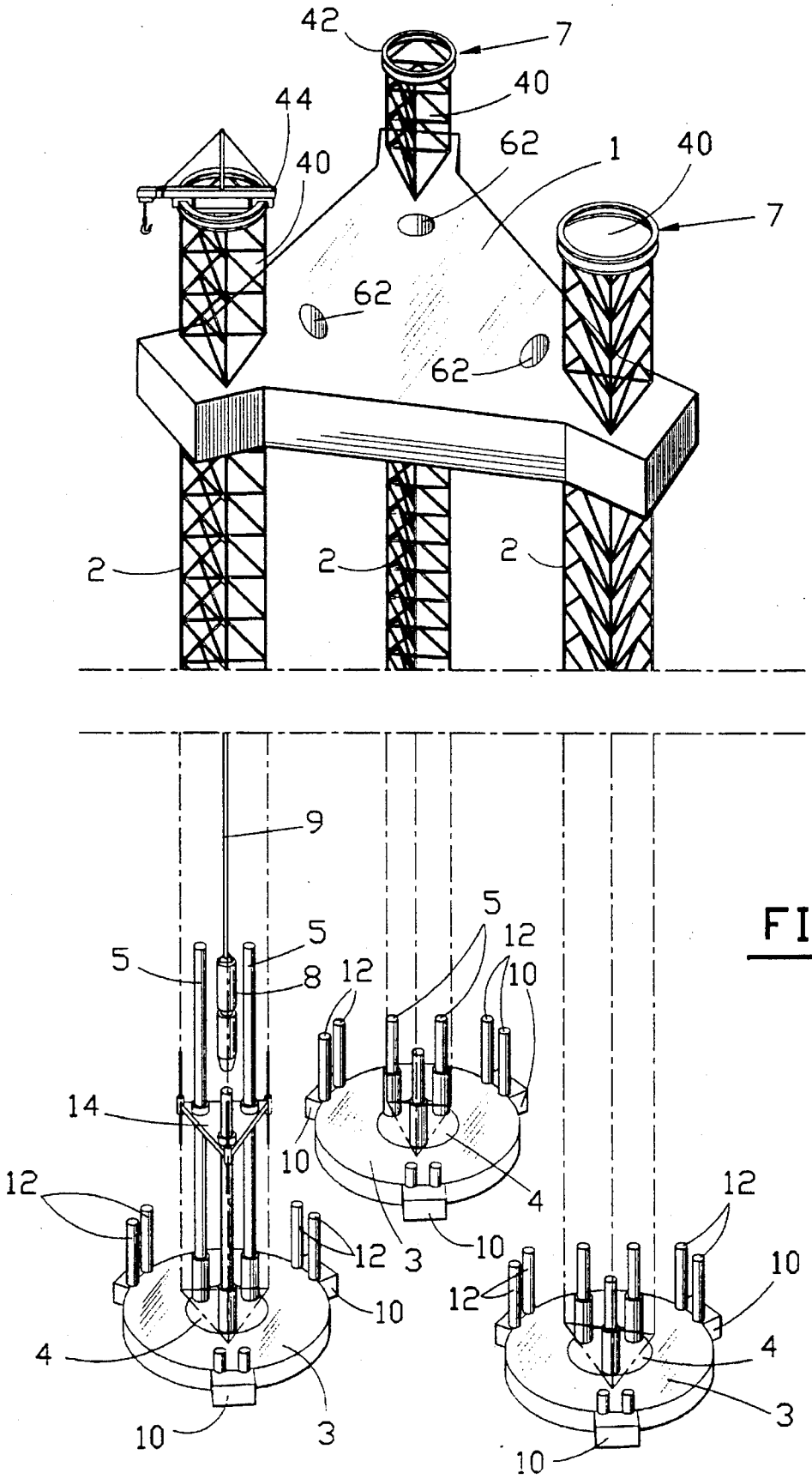
FIG. 1 is a diagrammatic perspective view of an oil platform according to the invention.

Shown in FIG. 1 is an oil drilling platform which may be either of the fixed or of the jack-up type and comprises a hull 1 carried by three legs 2 constructed in the form of a lattice of metal girders, each leg having a triangular cross-sectional shape.

Each of the legs 2 is provided at its lower end with a massive foot 3 in the shape of a disc or a triangle supporting the leg 2 in its central part and provided with a separable support 4 constituted by a central disc of smaller diameter carrying anchoring piles 5 located within the space defined by the walls of the leg 2. The anchoring piles 5 are piles of large section and are adapted to withstand the effects of the load exerted on the legs by the weight of the platform. For this purpose, the piles 5 must be deeply anchored in the ground below the sea bed.

Figure 4:
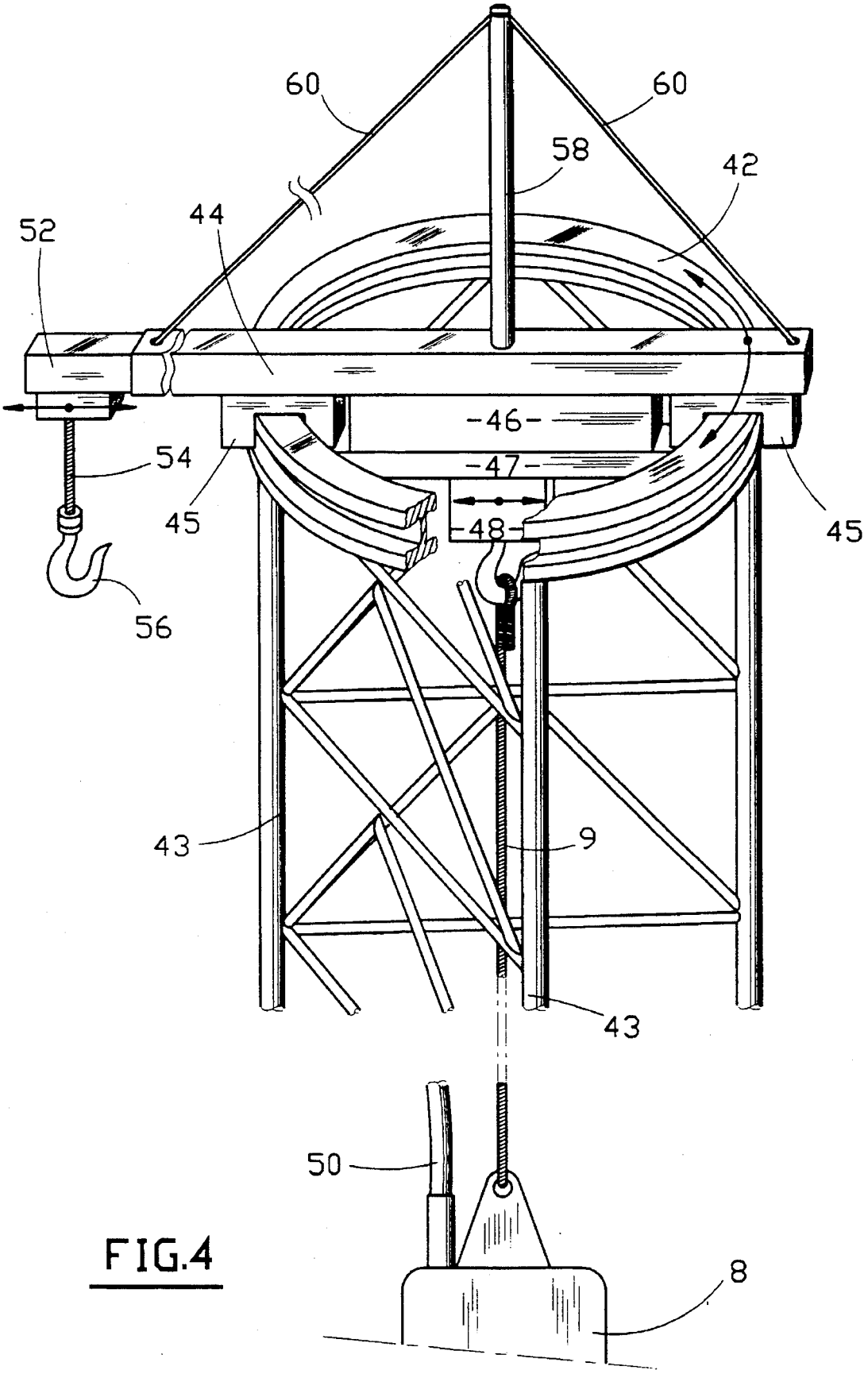
FIG. 4 is a partial perspective view of a pile driving device with which the legs of a platform are equipped in turn for the purpose of anchoring the legs in the ground below the sea bed.

In order to carry out this operation, each leg 2 comprises at its upper end remote from the foot 3 a cage 7 also constructed with metal girders and adapted to support in vertical alignment with the anchoring piles 5, a hammer 8 of hydraulic type suspended from the cage 7 by means of a cable 9 in a manner which will be described in more detail with reference to FIG. 4. In order to absorb the tilting forces which are produced by moments, each foot 3 in the shape of a disc or triangle includes on its periphery radial projections 10 angularly spaced 120° apart and carrying anchoring piles 12 of smaller section than the main anchoring piles 5, these peripheral piles being driven into the ground either by means of mobile equipment lighter than the conventional equipment employed for placing in position anchoring piles or by means of the hammer 8 carried by means which will also be described with reference to FIG. 4.

Each of the legs 2 is provided with means 14 for guiding the anchoring piles located within the space defined by the walls of the leg 2. These guide means may be formed by a plate occupying a transverse section of each leg and provided with axial orifices the number of which equals the number of anchoring piles 5 of each leg. In the presently-described embodiment, each leg has three main anchoring piles 5 and six peripheral anchoring piles.

Figure 2:
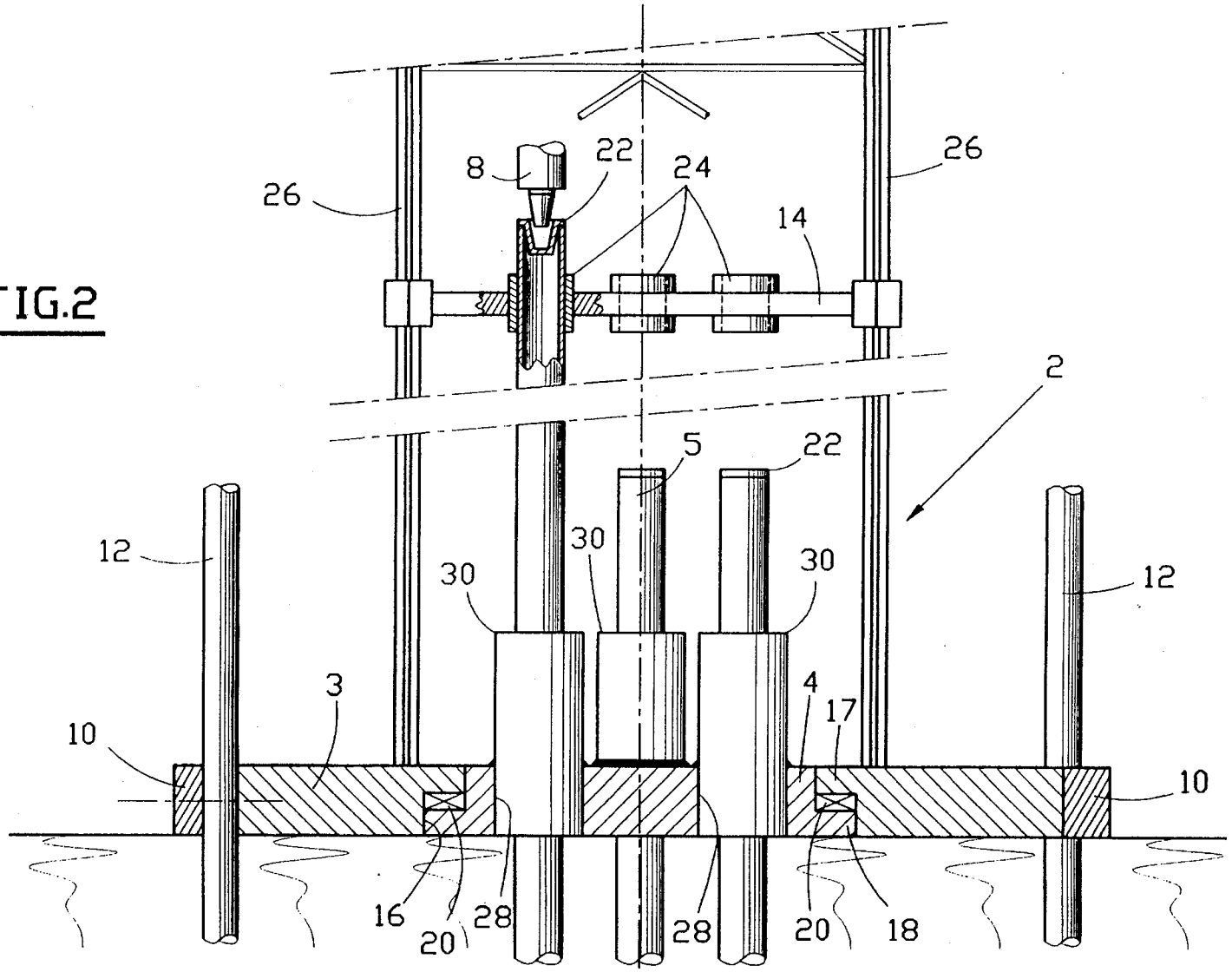
FIG. 2 is a diagrammatic sectional view to a larger scale taken on line 2—2 of FIG. 3, showing in more detail the anchoring piles of each leg of the platform according to the invention.

One of the legs of the platform according to the invention is partly shown in more detail and to a larger scale in FIG. 2.

As can be seen in this Figure, the disc-shaped foot comprises in its central part a recess 16 provided with a shoulder 17 adapted to cooperate with a complementary shoulder 18 provided on the support 4 for the anchoring piles 5 with interpositions of hydraulic cylinder devices 20 evenly spaced apart on the periphery of the support 4 and adapted to be maintained under pressure at the start of the positioning operations and in particular during the operations for driving the main anchoring piles, and to be released so that the load of each of the legs is transmitted through the disc 3 to the support 4 after the peripheral anchoring piles 12 have been placed in position.

At its end adapted to cooperate with the hammer 8, each anchoring pile 5 of tubular shape comprises a terminal member 22 for receiving the blows of the striking mass of the hammer 8.

The anchoring piles extend through the guide plate 14 through axial passages provided with sleeves 24 provided in the plate in vertical alignment with the positions of the piles 5 in their support 4. The guide plate 14 is fixed to the posts 26 of the leg 2.

The main anchoring piles 5 are mounted in axial bores 28 in the support 4 with interposition of devices 30 for axially immobilizing the piles 5 with respect to the support 4, for example constituted by sleeves connected to the foot and internally provided with suitable means (not shown) for fixing the anchoring piles in position relative to the sleeves.

The central anchoring piles 5 are each designed to support 3 to 4,000 tons whereas the peripheral piles 12 each support about 1,000 tons. It will therefore be understood that the latter may have smaller dimensions than those of the central piles and will be easier to lay without requiring the use of heavy equipment.

The peripheral anchoring piles 12 are disposed in apertures in the disc 3 constituting a foot and are each provided with a clamp 10 radially fixed to the disc 3 by destructible fixing means such as for example explosive bolts (not shown) adapted to permit, when withdrawing the platform, separating the foot 3 of the latter from the peripheral anchoring piles 12.

Figure 3:
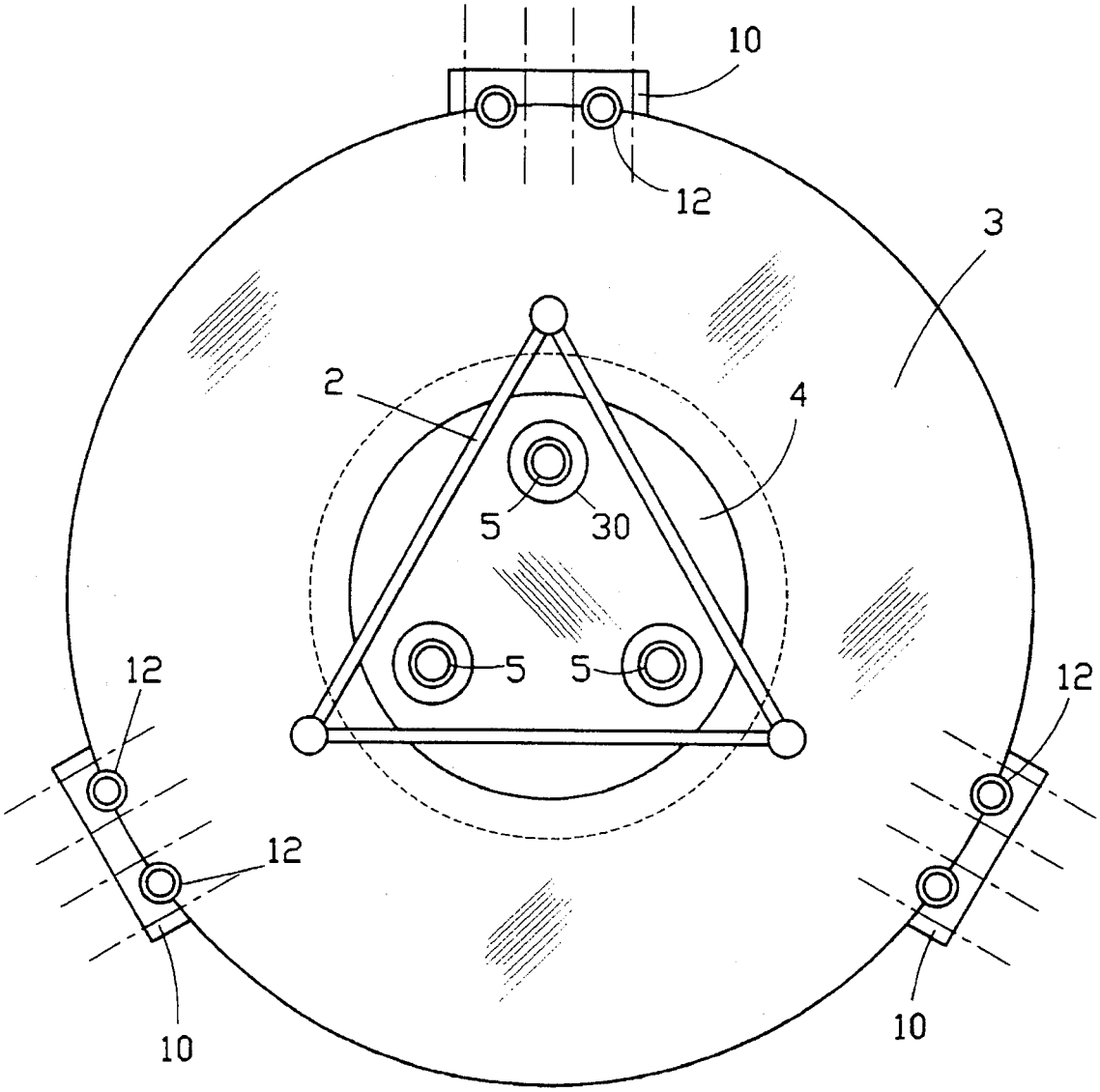
FIG. 3 is a plan view of the foot of the leg of the platform of FIG. 2.

As can be seen in FIG. 3, each leg of the platform according to the invention has an equilateral triangular cross-sectional shape. The main anchoring piles are also disposed in accordance with an equilateral triangle within the space defined by the lateral walls of the leg 5. The peripheral anchoring piles 12 are disposed at 120° with respect to the corners of the equilateral triangle defined by the cross-sectional shape of the leg 2. It must be understood that the invention is also applicable to platform legs which have different cross-sectional shapes and in particular to tubular legs of circular cross-sectional shape.

with reference again to FIG. 1, it can be seen that each leg 2 of the platform according to the invention includes at the end remote from the foot a cage 7 for receiving and supporting a hammer 8 for driving the central anchoring piles 5.

This cage has a generally prismatic shape. It is constructed by means of a lattice of metal girders and at least one of its sides facing toward the interior of the hull 1 has a passage 40 of sufficient size to allow the hammer 8 to pass therethrough for placing the hammer in position relative to the leg 2 of which the anchoring piles 5 must be driven by the hammer and for withdrawing the hammer by hoisting and handling means (not shown) provided on the platform for transferring the hammer to another leg of the platform. Each of the cages 7 has in its free upper part a circular rail 42 which is fixed to the ends of the vertical posts 43 of the corresponding leg and on which there is angularly movably mounted (as can be seen more clearly in FIG. 4) a first girder or boom 44 by means of two diametrically opposed carriages 45 which roll along the circular rail.

Mounted below the girder 44 by means of a cross-member 46 is a second girder 47 whose length is inscribed within the inside dieter of the circular rail 42 and on which is movably mounted a carriage 48 to which is hooked the cable 9 suspending the hydraulic hammer 8 which is provided with a pipe 50 supplying hydraulic fluid connected to a source of fluid under pressure carried by the hull 1 (not shown).

Thus it can be seen that, with the arrangement described with reference to FIG. 4, under the effect of the combined movements of the girder 44 and the carriage 48, the hammer 8 may be placed in succession in vertical alignment with each of the central three anchoring piles for driving the latter into the ground.

The girder 44 angularly movable on the circular rail 42 further comprises at one of its ends an extension member 52 telescopically engaged in the girder 44 and carrying at its free end a cable 54 provided with a hook 56 for the suspension of the hydraulic hammer 8 so as to permit using this hammer also for driving the peripheral anchoring piles 12.

The girder 54 carries in the middle thereof a mast 58 whose upper end is connected to the ends of the girder 44 by guys 60.

The angular movement of the girder 44 on its rail 42 enables its extension member 52 to reach any point on the periphery of the corresponding foot 3 and in particular to be located in succession in vertical alignment with the peripheral piles 12. To reach the piles located below the hull 1, the latter includes in association with each leg a passage 62 through which the hammer 8 can be descended (FIG. 1).

The hammer 8 and the hoisting and suspension means therefor constituted by the girder 44 and the carriages 45 are dismountable and transferrable, at the end of an operation for driving the anchoring piles of one leg 2, to the cage 7 of another leg.

The weight of such an assembly including the hammer may reach 100 tons or so and it might therefore be envisaged to handle this assembly by means of a hoisting equipment existing on the oil platform after slightly increasing its power if necessary.

There may also be used for transferring the hammer assembly a transfer device employing a cable which extends between two cages.

The arrangement just described may be employed both for a platform having fixed legs and for a jack-up platform. In the latter case, when the platform is in the towing position, the hull 1 which is then floating and the legs 2 are for the major part out of the water, the peripheral piles 12 which are normally located vertically below the surface of the hull are engaged in the passages 62 provided in the latter.

The other peripheral anchoring piles 12 are located outside the overall size of the hull 1.

It can be seen that, with the arrangement of the invention, it is possible to place an offshore oil producing platform in position by the use of mainly, and even solely, equipment already on the platform, and in any case, by the use of relatively small outside equipment for placing the peripheral anchoring piles 12 in position.

It will therefore be understood that the user of the platform benefits from an important reduction in costs and does not depend on the intervention of a third party for placing the platform of the user in position.

For withdrawing the platform at the end of a drilling or production operation, the disc-shaped feet 3 are separated from the peripheral piles 12 by destroying the fixing means providing the connection between the clamps 10 and the discs 3. Further, as the central shoulder 17 of the disc-shaped foot 3 faces toward the interior and is located above the complementary shoulder 18 of the support of the anchoring piles 5 facing toward the exterior, nothing opposes the raising of the legs 2 either by mechanical means carried by the hull if it concerns a jack-up platform, or by any other raising means if it concerns a platform having fixed legs.

The main anchoring piles 5 and the peripheral piles 12 remain driven into the ground after the withdrawal of the platform.

What is claimed is:

1. Offshore oil drilling or producing platform comprising legs each provided with a foot adapted to rest on the sea bed, a hull carried by said legs, each of said legs having walls which define a space opening onto the corresponding foot, piles within each space for anchoring the respective leg carried by said foot, support means in the upper part of each leg in vertical alignment with said piles within said space, and a device supported by said support means for driving said piles into the ground below said sea bed.

2. Platform according to claim 1, comprising a support which is a part of each foot and is separable from said foot and carries said anchoring piles.

3. Platform according to claim 1, comprising for each leg means for guiding said piles in the course of the driving of said piles.

4. Platform according to claim 1, comprising peripheral anchoring piles carried by each foot for withstanding tilting forces to which said platform is subjected in particular under the effect of swell of the sea.

5. Platform according to claim 2, wherein each foot has the shape of a disc and said support for said anchoring piles comprises a disc which has a diameter smaller than the diameter of said foot and includes a shoulder extending toward the exterior, said foot comprising a recess for said support and including a shoulder extending toward the interior and located above said shoulder of said support.

6. Platform according to claim 5, comprising hydraulic jacks which are adapted to be released after the positioning of said anchoring piles disposed in said legs and are disposed between said respective shoulders of said foot and said support and are evenly spaced apart on the periphery of said support.

7. Platform according to claim 1, comprising a device associated with each anchoring pile disposed in the respective leg for axially immobilizing the respective pile relative to said support after said pile has been driven into said ground below said sea bed.

8. Platform according to claim 2, wherein said anchoring pile-guiding means inside the respective leg comprise a guide plate and axial passages provided with sleeves in said guide plate in vertical alignment with positions of said piles in said support therefor.

9. Platform according to claim 1, wherein said means for supporting said device for driving said piles comprise a cage provided at an end of each leg remote from said foot thereof, said cage comprising at a free end thereof a circular rail fixed to vertical posts of the respective leg, a first girder angularly movably mounted on said circular rail, a second girder connected to said first girder and having a length which is inscribed within the inside diameter of said circular rail, a carriage movably mounted on said second girder, and a suspension cable for said driving device carried by said carriage.

10. Platform according to claim 9, wherein said cage comprises on at least one of sides thereof facing toward the interior of said hull a passage of sufficient dimensions for allowing said driving device to pass therethrough so as to place said device in position relative to the respective leg the anchoring piles of which must be driven by said driving device, and for allowing the withdrawal of said driving device for transferring said driving device to another leg of said platform.

11. Platform according to claim 1, wherein said driving device is a hydraulic hammer.

12. Platform according to claim 9, wherein said first girder comprises at an end thereof an extension member telescopically engaged in said first girder and carrying adjacent a free end of said extension member means for suspending said driving device and permitting the use of said driving device also for driving peripheral anchoring piles.

13. Platform according to claim 12, wherein said hull comprises passages for said driving device to permit the driving of said peripheral anchoring piles located below and within the overall size of said hull, said passages in said hull also serving to receive the corresponding peripheral anchoring piles in a raised position of said legs when transporting said platform to a site at which it is to be placed in position.

14. Platform according to claim 9, wherein said first girder is connected to said circular guide rail by diametrically opposed carriages.

* * * * *